US011404774B2

(12) United States Patent
Chang et al.

(10) Patent No.: US 11,404,774 B2
(45) Date of Patent: Aug. 2, 2022

(54) BROADBAND DUAL ANTENNA SYSTEM

(71) Applicant: ASUSTeK COMPUTER INC., Taipei (TW)

(72) Inventors: Wei-Hsuan Chang, Taipei (TW); Fang-Hsien Chu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 30 days.

(21) Appl. No.: 17/155,195

(22) Filed: Jan. 22, 2021

(65) Prior Publication Data

US 2021/0242580 A1 Aug. 5, 2021

(30) Foreign Application Priority Data

Jan. 31, 2020 (TW) ..... 109103101

(51) Int. Cl.

| | |
|---|---|
| ***H01Q 1/24*** | (2006.01) |
| ***H01Q 1/52*** | (2006.01) |
| ***H01Q 7/00*** | (2006.01) |
| ***H01Q 1/48*** | (2006.01) |

(52) U.S. Cl.

CPC ..... *H01Q 1/52* (2013.01); *H01Q 1/241* (2013.01); *H01Q 1/48* (2013.01); *H01Q 7/00* (2013.01)

(58) Field of Classification Search

CPC ..... H01Q 1/52; H01Q 1/241; H01Q 1/48; H01Q 7/00

See application file for complete search history.

(56) References Cited

U.S. PATENT DOCUMENTS

| | | | | |
|---|---|---|---|---|
| 2012/0194391 | A1* | 8/2012 | Liu | H01Q 21/28 343/700 MS |
| 2016/0093949 | A1 | 3/2016 | Chang et al. | |
| 2020/0021021 | A1* | 1/2020 | Lin | H01Q 5/307 |

FOREIGN PATENT DOCUMENTS

| | | | |
|---|---|---|---|
| CN | 105762513 | B | 7/2016 |
| CN | 109659686 | A | 4/2019 |
| TW | I539674 | B | 4/2016 |
| TW | M584024 | U | 9/2019 |

* cited by examiner

*Primary Examiner* — Dieu Hien T Duong

(74) *Attorney, Agent, or Firm* — McClure, Qualey & Rodack, LLP

(57) ABSTRACT

A broadband dual-antenna system provided herein comprises: a dielectric substrate including a first surface and a second surface; a grounding plane on the dielectric substrate; a loop metal branch located on the first surface and connected to the grounding plane; a coupling metal branch located on the second surface and connected to the grounding plane, the vertical projection of the coupling metal branch and that of the loop metal branch on the second surface partially overlap; a first metal branch located on the second surface and the coupling metal branch; a second metal branch located on the second surface and the coupling metal branch; a first signal source located on the second surface and connected to the first metal branch and the grounding plane; and a second signal source located on the second surface and connected to the second metal branch and the grounding plane.

9 Claims, 4 Drawing Sheets

BROADBAND DUAL ANTENNA SYSTEM

CROSS-REFERENCE TO RELATED APPLICATION

This application claims the priority benefit of Taiwan applications serial No. 109103101, filed on Jan. 31, 2020. The entirety of the above-mentioned patent application is hereby incorporated by reference herein and made a part of specification.

BACKGROUND OF THE INVENTION

Field of the Invention

The invention relates to a broadband dual antenna system.

Description of the Related Art

For the existing dual antenna integrated design, in order to solve the isolation problem between the dual antennas, lumped elements, such as resistive elements or capacitive elements, are commonly added between the dual antennas. However, this approach is usually applicable to narrow-bands. To achieve a wide-band response, more lumped elements are required, which increases the overall complexity of the antenna and increases the cost. Furthermore, the existing dual-antenna integrated designs still use separate structures, so the degree of integration is limited by physical size.

BRIEF SUMMARY OF THE INVENTION

According to one aspect, a broadband dual antenna system is provided. The broadband dual antenna system includes a dielectric substrate including a first surface and a second surface opposite to each other; a grounding plane located on a side edge of the dielectric substrate; a loop metal branch located on the first surface of the dielectric substrate and connected to the grounding plane; a coupling metal branch located on the second surface of the dielectric substrate and connected to the grounding plane, the vertical projection of the coupling metal branch and that of the loop metal branch on the second surface partially overlap; a first metal branch located on the second surface of the dielectric substrate and located on one side of the coupling metal branch; a second metal branch located on the second surface of the dielectric substrate and located on the other side of the coupling metal branch; a first signal source located on the second surface of the dielectric substrate and connected to the first metal branch and the grounding plane; and a second signal source located on the second surface of the dielectric substrate, and connected to the second metal branch and the grounding plane.

The broadband dual antenna system provided herein uses the design of dual antennas sharing radiating metal branches to achieve large-scale integration to save overall space. In addition, use antenna multi-mode integration to achieve wide-band operation mode and increase isolation, in order to comply with 5G NR n77/78/79 (3.3 GHz~5 GHz) spectrum specifications.

These and other features, aspects and advantages of the present invention will become better understood with regard to the following description, appended claims, and accompanying drawings.

DETAILED DESCRIPTION OF THE EMBODIMENTS

Figure 1:
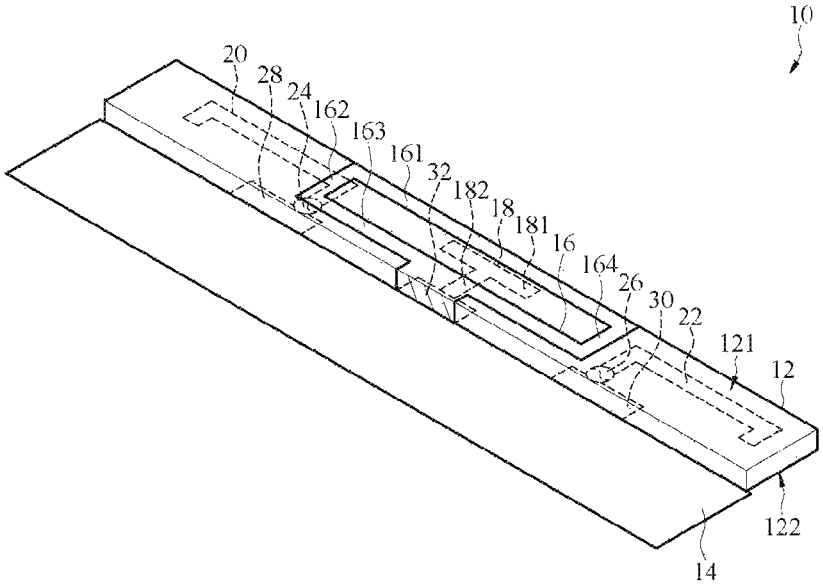
FIG. 1 is a perspective schematic view of a broadband dual antenna system according to an embodiment.
Figure 2:
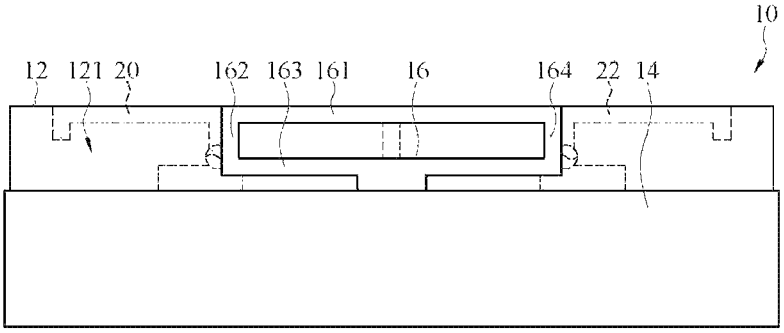
FIG. 2 is a schematic top view of the broadband dual antenna system according to an embodiment.
Figure 3:
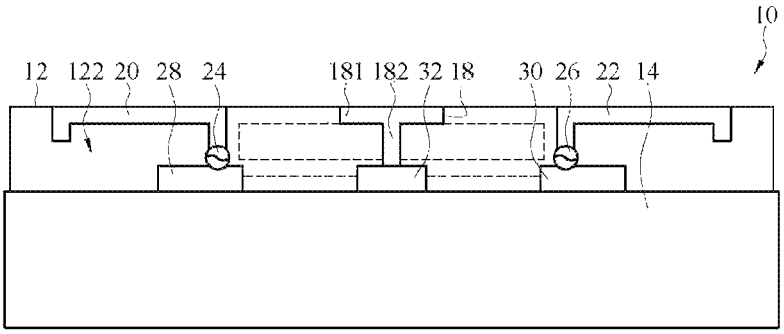
FIG. 3 is a schematic bottom view of the broadband dual antenna system according to an embodiment.

Please refer to FIG. 1, FIG. 2 and FIG. 3. A broadband dual antenna system 10 includes a dielectric substrate 12, a grounding plane 14, a loop metal branch 16, a coupling metal branch 18, a first metal branch 20, a second metal branch 22, a first signal source 24, and a second signal source 26. The grounding plane 14 is located on a side edge of the dielectric substrate 12, and the dielectric substrate 12 includes a first surface 121 and a second surface 122. The loop metal branch 16 is disposed on the first surface 121 of the dielectric substrate 12. The coupling metal branch 18, the first metal branch 20, the second metal branch 22, the first signal source 24 and the second signal source 26 are disposed on the second surface 122 of the dielectric substrate 12.

In one embodiment, the grounding plane 14 is a circuit ground of the electronic device, which is also provided as the outer casing of the electronic device or a metal part inside the plastic casing of the electronic device, which is not limited herein. The size of the grounding plane 14 drawn in the figure is only an illustration, and it should not be limited herein.

In the broadband dual antenna system 10, the loop metal branch 16 is located on the first surface 121 of the dielectric substrate 12 and connected to the grounding plane 14. The coupling metal branch 18 on the second surface 122 of the dielectric substrate 12 is connected to the grounding plane 14, the coupling metal branch 18 and the loop metal branch 16 partially overlap the vertical projection of the second surface 122. The first metal branch 20 is located on the second surface 122 of the dielectric substrate 12 and located on one side of the coupling metal branch 18, which makes the vertical projection of the first metal branch 20 and the loop metal branch 16 on the second surface 122 partially overlap. The second metal branch 22 is located on the second surface 122 of the dielectric substrate 12, and on the other side of the coupling metal branch 18 opposite the first metal branch 20, which makes the vertical projection of the second metal branch 22 and the vertical projection of the loop metal branch 16 on the second surface 122 partial overlap. In one embodiment, the first metal branch 20 and the second metal branch 22 are located on opposite sides of the coupling metal branch 18, and extend opposite each other, which makes the first metal branch 20 and the second metal branch 22 have mirror symmetry relative to the coupling metal branch 18. The first signal source 24 and the second signal source 26 are located on the second surface 122 of the dielectric substrate 12 and located on both sides of the coupling metal branch 18. The positive electrode of the first signal source 24 is connected to the first metal branch 20, and the negative electrode of the first signal source 24 is connected to the grounding plane 14. The positive electrode of the second signal source 26 is connected to the second metal branch 22, and the negative electrode of the second signal source 26 is connected to the grounding plane 14. The first signal source 24 and the second signal source 26 are configured to receive or transmit a radio frequency signal.

In an embodiment, the loop metal branch 16 includes a first metal segment 161, a second metal segment 162, a third metal segment 163 and a fourth metal segment 164 adjacent to each other. The first metal segment 161 is parallel to the third metal segment 163 and perpendicular to the second metal segment 162 and the fourth metal segment 164, and the second metal segment 162 is parallel to the fourth metal segment 164. Therefore, the vertical projection of the first metal segment 161 of the loop metal branch 16 on the second surface 122 of the dielectric substrate 12 overlaps with the coupling metal branch 18. The coupling metal branch 18 is a T-shaped coupling metal branch. The coupling metal branch 18 includes a horizontal metal segment 181 and a vertical metal segment 182 vertically connected to the horizontal metal segment 181. The horizontal metal segment 181 overlaps with the vertical projection of the first metal segment 161 of the loop metal branch 16 on the second surface 122, an therefore a first coupling distance is maintained between the horizontal metal segment 181 of the coupling metal branch 18 and the loop metal branch 16, and the vertical metal segment 182 is connected to the grounding plane 14. In an embodiment, the coupling metal branch 18 has a T shape, which is not limited herein. As long as the coupling metal branch 18 overlaps the vertical projection of the loop metal branch 16 on the second surface 122, the coupling metal branch 18 can be of any shape design.

In one embodiment, the vertical projection of the second metal segment 162 of the loop metal branch 16 on the second surface 122 of the dielectric substrate 12 partially overlaps with the first metal branch 20, and a second coupling distance is maintained between the first metal branch 20 and the loop metal branch 16. The vertical projection of the fourth metal segment 164 of the loop metal branch 16 on the second surface 122 of the dielectric substrate 12 partially overlaps with the second metal branch 22, and a third coupling distance is maintained between the second metal branch 22 and the loop metal branch 16.

In one embodiment, the first coupling distance, the second coupling distance, and the third coupling distance are the same distance, which are all equal to the thickness of the dielectric substrate 12.

In one embodiment, to facilitate the first signal source 24 and the second signal source 26 to connect to the broadband dual antenna system 10, a first grounding connecting portion 28 and a second grounding connecting portion 30 are further disposed on the second surface 122 of the dielectric substrate 12. The first grounding connecting portion 28 is electrically connected with the negative electrode of the first signal source 24 and the grounding plane 14, and the second grounding connecting portion 30 is electrically connected with the negative electrode of the second signal source 26 and the grounding plane 14. In addition, a third grounding connecting portion 32 is further disposed on the second surface 122 of the dielectric substrate 12 to electrically connect the vertical metal segment 182 of the coupling metal branch 18 to the grounding plane 14.

In one embodiment, the loop metal branch 16, the coupling metal branch 18, the first metal branch 20, the second metal branch 22, the first grounding connecting portion 28, the second grounding connecting portion 30, and the third grounding connecting portion 32 are made of conductive materials, such as copper, silver, aluminum, iron or its alloys, which is not limited herein.

The high frequency band of the broadband dual antenna system 10 is contributed by the resonance of the first metal branch 20 and the second metal branch 22 at high frequencies, and the low frequency band is contributed when the first metal branch 20 and the second metal branch 22 respectively couple and excite with the loop metal branch 16 to generate resonance at low frequencies. When a radio frequency signal is fed from the first signal source 24, the first metal branch 20 excites a resonance mode with ¼ wavelength, for contributing to the high frequency. At the same time, the first metal branch 20 partially overlaps with the second metal segment 162 of the loop metal branch 16, thereby coupling and exciting the resonance mode with 1 wavelength of the loop metal branch 16 to contribute to the low frequency. By combining the two resonance modes with high and low frequency, broadband operation is achieved to meet the 5G NR band specification. In one embodiment, the broadband dual antenna system 10 is a symmetrical architecture. When a radio frequency signal is fed from the second signal source 26, the high frequency resonance mode is contributed by the second metal branch 22. Since the second metal branch 22 partially overlaps with the fourth metal segment 164 of the loop metal branch 16, the second metal branch 22 couples and excites the loop metal branch 16 to form low frequency resonance modes. Similarly, the combination of the low frequency and the high frequency resonance modes becomes a broadband operation. However, as the first metal branch 20 and the second metal branch 22 both use the 1 wavelength resonance of the loop metal branch 16 to generate low frequency resonance modes, a low frequency coupling energy (1 wavelength resonance mode) and a double frequency coupling energy (1.5 times wavelength resonance mode) is transmitted to another signal source, which causes the isolation to decrease when the resonance modes are generated. With the effect of the coupling metal branch 18, the coupling energy of the 1.5 times wavelength resonance mode of the loop metal branch 16 is reduced to the same operating frequency band as the 1 wavelength resonance mode, to achieve good isolation between the first signal source 24 and the second signal source 26. Therefore, in the same frequency band, when 1 wavelength and 1.5 times wavelength of the resonance mode operating at the same time, two coupling energies are formed to be coupled to another signal source, and the two coupling energies are opposite to each other, so the two coupling energies cancel each other out, thereby achieving good isolation.

Figure 4:
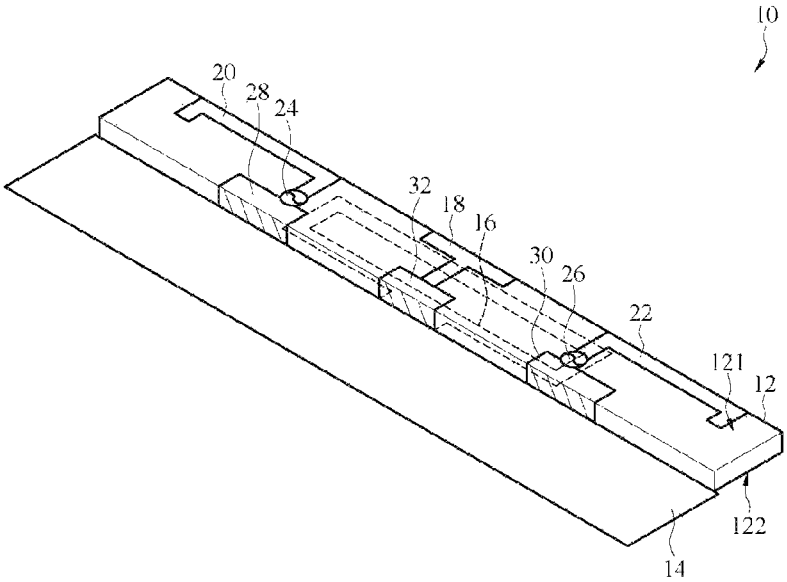
FIG. 4 is a perspective schematic view of the broadband dual antenna system according to another embodiment.

Please refer to FIG. 4, in the broadband dual antenna system 10, the first surface 121 of the dielectric substrate 12 is provided with the coupling metal branch 18, the first metal branch 20, the second metal branch 22, the first signal source 24, the second signal source 26, the first grounding connecting portion 28, the second grounding connecting portion 30 and the third grounding connecting portion 32. On the second surface 122 of the dielectric substrate 12 is only provided with the loop metal branch 16. The difference between FIG. 4 and FIG. 1 is that the element configurations on the first surface 121 and the second surface 122 of the dielectric substrate 12 are opposite, and the rest of the structure and action are the same as the embodiment of FIG. 1, so please refer to the previous description, and will not repeat it here.

Figure 5:
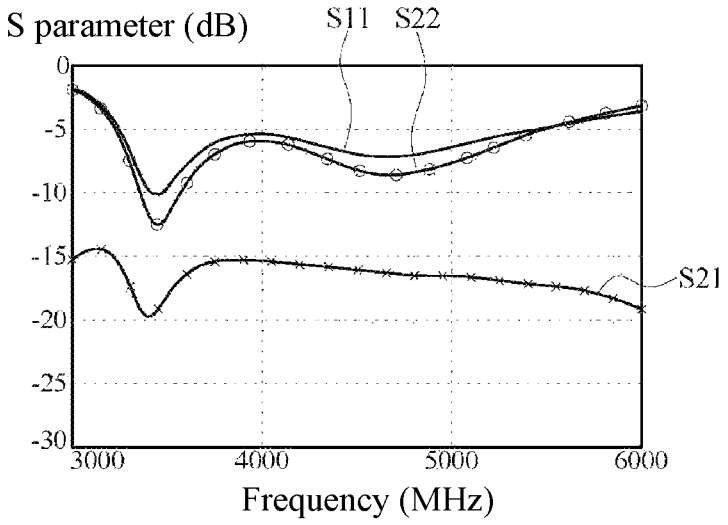
FIG. 5 is an S-parameter simulation schematic diagram of the broadband dual antenna system according to an embodiment.

Please refer to FIG. 1 to FIG. 3 and FIG. 5 at the same time. Take the broadband dual antenna system with an actual total length of 35 mm and a width of 5 mm as an example. The S parameter is simulated during the radio frequency signal is transmitted. The S parameter simulation results are shown in FIG. 5 When operating in a wide frequency band (3.3 GHz~5 GHz), the isolation curve (S21) below the graph is less than −15 dB in the operating frequency band of 3.3 GHz~5 GHz. Therefore, it has good isolation in the entire broadband operating frequency band. Consequently, the broadband dual antenna system 10 has good isolation in the broadband operating frequency band to comply with the 5G NR n77/78/79 (3.3 GHz-5 GHz) spectrum specification.

In summary, in order to solve the problem of high integration of dual antennas, the broadband dual antenna system achieves the effect of miniaturization by sharing the loop metal branch, so that the antenna has better space utilization and is very suitable for applications in electronic devices with dual antennas. At the same time, the antenna multi-mode integration technique is used to achieve broadband operation, and in conjunction with the coupling metal branch, the isolation of the antenna is greatly improved. In addition, the broadband dual antenna system design eliminates the bandwidth limitation and energy consumption of lumped elements, so it has excellent performance in isolation, bandwidth and radiation efficiency.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A broadband dual antenna system, comprising:

a dielectric substrate, including a first surface and a second surface opposite to each other;

a grounding plane, located on a side edge of the dielectric substrate;

a loop metal branch, located on the first surface of the dielectric substrate and connected to the grounding plane;

a coupling metal branch, located on the second surface of the dielectric substrate and connected to the grounding plane, the vertical projection of the coupling metal branch and that of the loop metal branch on the second surface partially overlap;

a first metal branch, located on the second surface of the dielectric substrate and located on one side of the coupling metal branch;

a second metal branch, located on the second surface of the dielectric substrate and located on the other side of the coupling metal branch;

a first signal source, located on the second surface of the dielectric substrate and connected to the first metal branch and the grounding plane; and a second signal source, located on the second surface of the dielectric substrate, and connected to the second metal branch and the grounding plane.

2. The broadband dual antenna system according to claim 1, wherein the vertical projection of the loop metal branch on the second surface overlaps with the first metal branch and the second metal branch respectively.

3. The broadband dual antenna system according to claim 2, wherein the loop metal branch comprises a first metal segment, a second metal segment, a third metal segment, and a fourth metal segment that are adjacent to each other, the first metal segment is parallel to the third metal segment and perpendicular to the second metal segment and the fourth metal segment, and the second metal segment is parallel to the fourth metal segment.

4. The broadband dual antenna system according to claim 3, wherein the vertical projection of the first metal segment on the second surface overlaps the coupling metal branch.

5. The broadband dual antenna system according to claim 4, wherein the coupling metal branch comprises a horizontal metal segment and a vertical metal segment vertically connected the horizontal metal segment, the horizontal metal segment overlaps the vertical projection of the first metal segment on the second surface, and the vertical metal segment is connected to the grounding plane.

6. The broadband dual antenna system according to claim 3, wherein the vertical projection of the second metal segment on the second surface partially overlaps the first metal branch.

7. The broadband dual antenna system according to claim 6, wherein the vertical projection of the fourth metal segment on the second surface partially overlaps the second metal branch.

8. The broadband dual antenna system according to claim 1, further comprising a first grounding connecting portion and a second grounding connecting portion located on the second surface of the dielectric substrate, the first grounding connecting portion is connected with the first signal source and the grounding plane, and the second grounding connecting portion is connected with the second signal source and the grounding plane.

9. The broadband dual antenna system according to claim 1, further comprising a third grounding connecting portion located on the second surface of the dielectric substrate and connected to the coupling metal branch and the grounding plane.

* * * * *